US005519903A

United States Patent [19]

Constantinescu

[11] Patent Number: 5,519,903

[45] Date of Patent: May 28, 1996

[54] STEEL SPAN FOR USE IN MATTRESS FOUNDATION FRAMES

[75] Inventor: Eugen Constantinescu, Westlake, Ohio

[73] Assignee: Ohio Mattress Company Components & Licensing Group, Cleveland, Ohio

[21] Appl. No.: 382,424

[22] Filed: Feb. 2, 1995

Related U.S. Application Data

[63] Continuation-in-part of Ser. No. 32,335, Dec. 16, 1994.

[51] Int. Cl.[6] ..... A47C 23/02

[52] U.S. Cl. ..... 5/264.1; 5/247

[58] Field of Search ..... 5/264.1, 263, 246, 5/247, 265; 267/103; D6/503; D25/131

[56] References Cited

U.S. PATENT DOCUMENTS

| | | | |
|---|---|---|---|
| D. 234,566 | 3/1975 | Watts | D6/503 |
| 773,312 | 10/1904 | D'Arcy . | |
| 1,095,712 | 5/1914 | D'Arcy . | |
| 2,237,585 | 8/1941 | De Fries . | |
| 3,506,987 | 4/1970 | Bielak . | |
| 3,755,833 | 9/1973 | Slominski | 5/247 |
| 3,916,463 | 11/1975 | Higgins | 5/246 |
| 3,971,081 | 7/1976 | Roe | 5/246 |
| 4,129,908 | 12/1978 | Wagner | 5/247 |
| 4,163,296 | 8/1979 | Kitchen et al. | 5/264.1 |
| 4,218,790 | 8/1980 | Mizelle | 5/247 |
| 4,861,002 | 8/1989 | Dabney | 5/264.1 |

*Primary Examiner*—Alexander Grosz
*Attorney, Agent, or Firm*—Calfee Halter & Griswold

[57] ABSTRACT

An improved steel span for use in mattress foundations has increased strength and rigidity characteristics achieved by a longitudinal ridge formed in a center section of the span between vertical legs of the span. The central location of the ridge in the cross-section of the span centers and thereby improves precise formation of symmetrical halves of the span which in turn insures accurate alignment of opposing spring-receiving slots formed in the vertical legs. Widened horizontally disposed base sections at the bottom of the vertical legs further increase rigidity and provide a greater surface area for attachment of the spans to a foundation frame.

1 Claim, 2 Drawing Sheets

STEEL SPAN FOR USE IN MATTRESS FOUNDATION FRAMES

RELATED APPLICATIONS

This application is a continuation-in-part of Design application Ser. No. 29/032,335, filed Dec. 16, 1994.

FIELD OF THE INVENTION

The present invention relates generally to mattress foundation structures and, in particular, to steel spans used as structural members in mattress foundations.

BACKGROUND OF THE INVENTION

Steel structural members have been used in the construction of mattress foundations, such as disclosed in U.S. Pat. Nos. 4,129,908, and 4,218,790 as for example laterally arranged cross members attached at ends to a rectangular frame to provide increased strength and rigidity. An array of steel members or spans may be perpendicularly intersected by a longitudinally disposed center beam passing underneath the spans and also attached to the wooden rectangular frame. Steel spans also serve to support foundation springs which, as disclosed for example in U.S. Pat. Nos. 3,971,081 and 4,779,292 are inserted into cross-sectional slots formed in opposing walls of the steel spans.

Such steel spans have been formed in generally U-shaped cross-sectional configurations having opposed walls in order to attain desired strength and flexure characteristics, and to enable formation of the cross-sectional slots in opposed walls into which the foundation springs are inserted. However, improvements have not been made to steel span designs which optimize strength and flexure characteristics and which improve ease and accuracy of production and quality control. To produce steel spans with progressive roller dies in a U-shaped cross-section with a rounded portion connecting the vertical walls have been unsuccessful due to the tendency of the span to roll or scew off of the longitudinal centerline.

SUMMARY OF THE INVENTION

The present invention overcomes these and other disadvantages of the prior art by providing a mattress foundation steel span having a unique cross-section configuration which has increased strength, rigidity and moment of inertia achieved by formation of a center convex ridge formed in a crown portion connecting opposed vertical walls.

In accordance with certain aspects of the present invention, an improved steel span for use as a structural element in mattress foundations is formed as an elongate beam having a multidimensional cross-section which includes symmetrical base portions having generally horizontal surfaces for contact with a mattress foundation frame, symmetrical generally vertical walls spaced apart and attached through radiused bends to the base portions, the vertical walls having a vertical height greater than a horizontal width of each of the base portions, symmetrical horizontally and vertically aligned slots in opposing portions of the vertical walls, the aligned slots being dimensioned to receive base portions of a spring element of a mattress foundation, a symmetrical crowned portion above the aligned slots connected through radiused bends to top ends of the vertical walls and connected to coplanar flat surfaces generally parallel with the base portions, the coplanar flat surfaces having a combined horizontal width equal to at least one half the spaced distance of the vertical walls, and a center convex ridge formed along the centerline of the cross-section of the steel span connected to laterally inward opposed edges of the coplanar flat surfaces, the center convex ridge having a rounded top disposed vertically above said coplanar flat surfaces.

In accordance with another aspect of the invention, a method of forming the novel steel span of the above described configuration includes the steps of first forming the center convex ridge along a longitudinal center line of the span and subsequently forming the bends in the span about the center convex ridge by using the center convex ridge as a referencing line about which symmetrical longitudinal halves of the span are formed.

These and other aspects of the invention are described in detail below with reference to the accompanying Figures wherein like reference numerals refer to like parts.

DETAILED DESCRIPTION OF A PREFERRED EMBODIMENT

Figure 1:
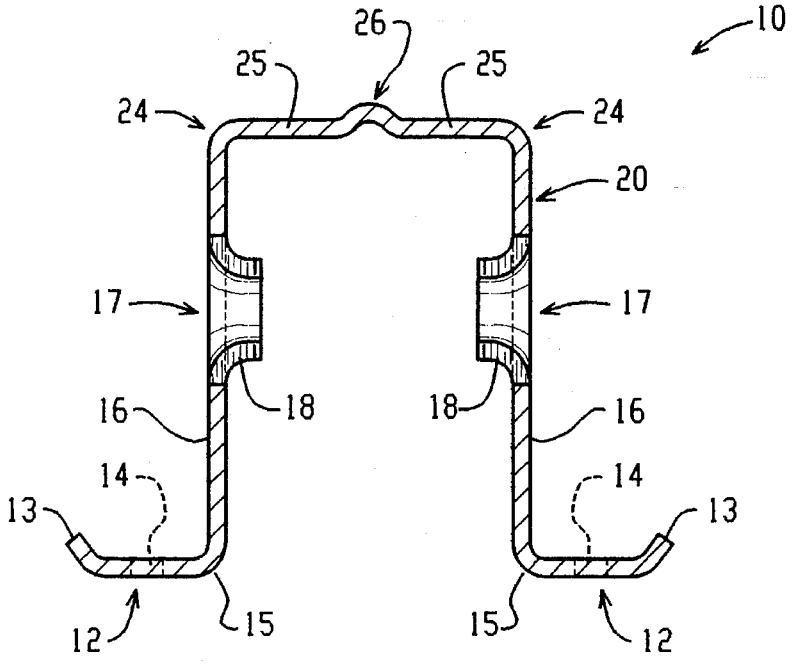
FIG. 1 illustrates a cross-section of an improved steel span of the present invention.
Figure 2:
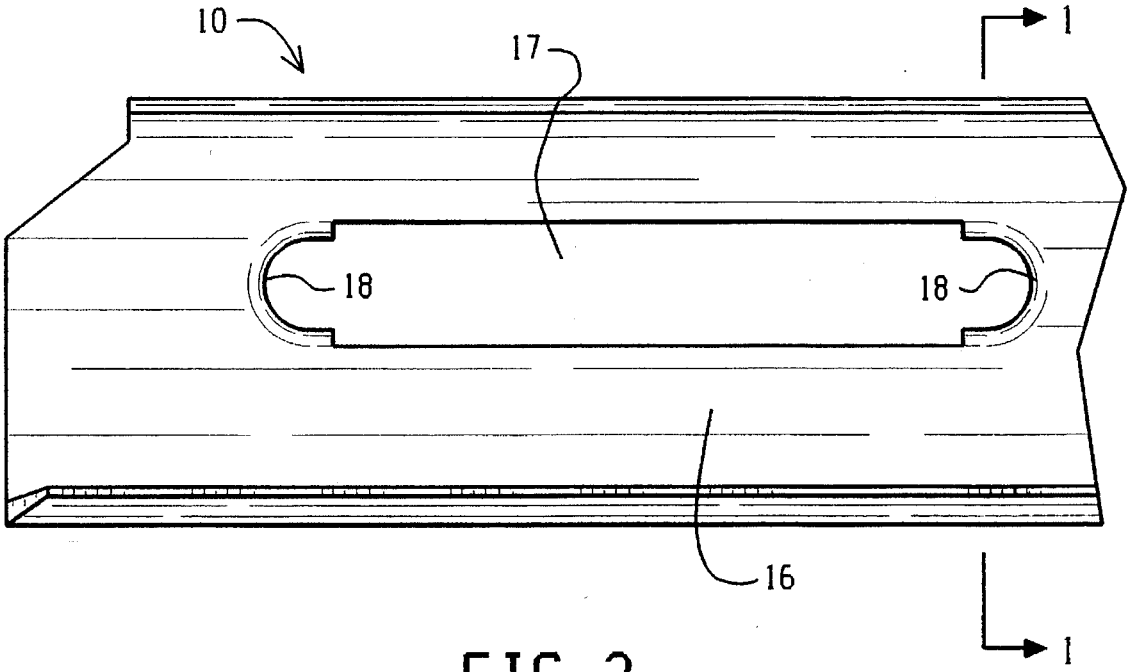
FIG. 2 illustrates a side elevation of the cross-section of the present invention.

As shown in FIG. 1, which is a cross-section of the novel steel span 10 of the invention, taken along the line 1—1 in FIG. 2, has the characteristic features of relatively wide symmetrical base portions 12 having upwardly flared outer edges 13, radiused slightly laterally beyond fastener holes 14 provided for insertion of a staple or the like to secure the span to a foundation frame. Laterally inner ends of base portions 12 are connected by radiused bends 15 to generally vertical symmetrical walls 16 in which opposing aligned slots 17 are formed to receive a foundation spring base in the manner described in U.S. Pat. No. 4,218,790, incorporated herein by reference. As shown in FIG. 2, radiused ends of slots 17 may be formed with thrust bearing surfaces 18 in the manner described in U.S. Pat. No. 4,779,292, also incorporated herein by reference.

Figure 3:
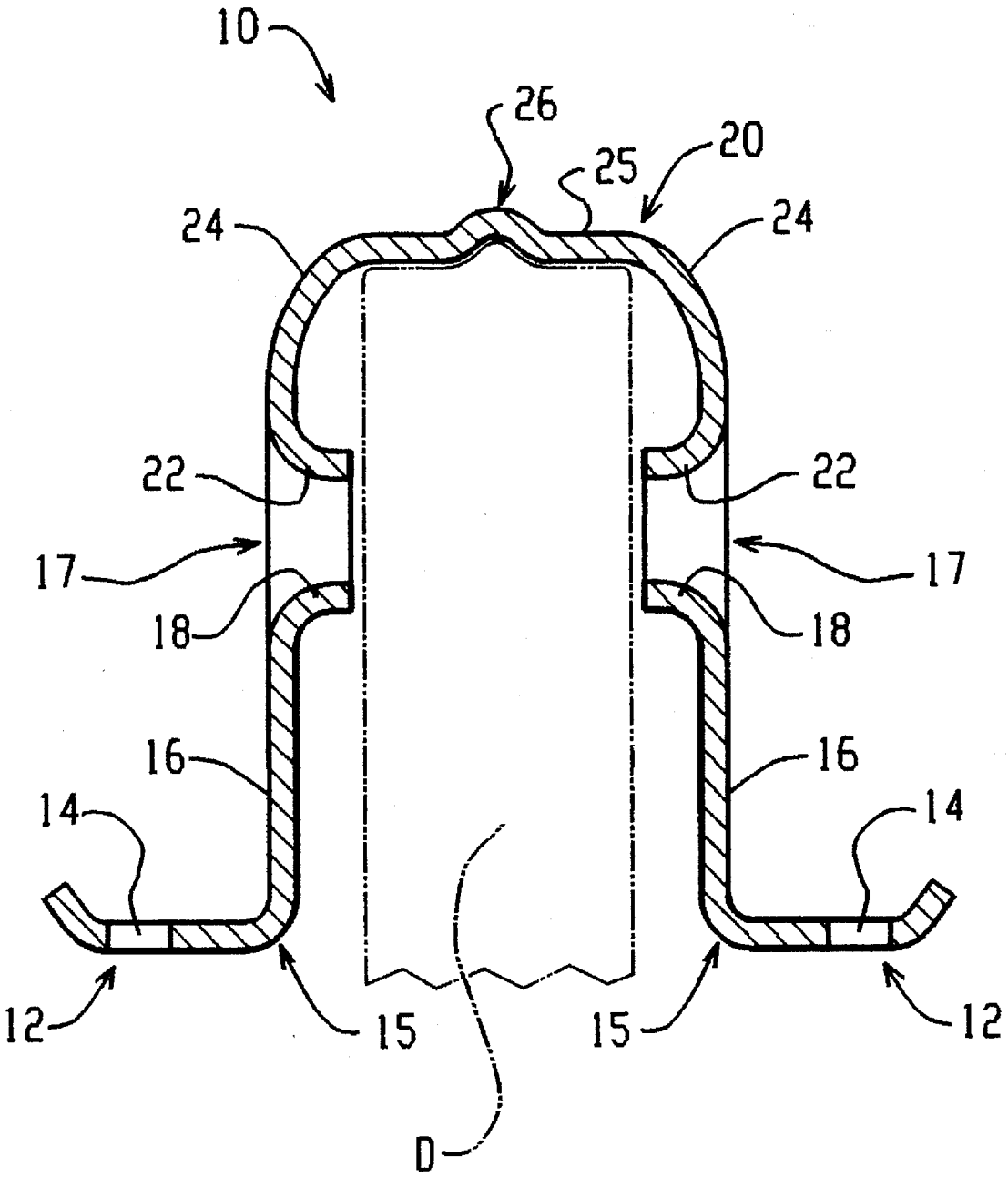
FIG. 3 illustrates a cross-section of an alternate embodiment of an improved steel span of the present invention.

Above slots 17, the span 10 is provided with a generally dome-shaped symmetrical crown section 20 including upper radiused corners 24 and opposing coplanar flat surfaces 25. In an alternate embodiment of the invention shown in FIG. 3, lower radiused corners 22 are formed above slots 17 in vertical walls 16 to provide a greater overall curvature to the cross-section of crown section 20. In both embodiments, the overall height of walls 16 is relatively great, i.e., greater than the combined horizontal width of base portions 12, to further increase the moment of inertia of the span. Also, the radius of curvature of upper radiused corners and/or lower radiused corners may be selectively increased or decreased to achieve a desired moment of inertia, stiffness and appearance to the steel span.

Disposed along the longitudinal centerline of symmetrical crown section 20 is a center convex ridge 26 which protrudes vertically above flat surfaces 25. To produce the steel span 10 by use of progressive roller dies applied to steel stock as is known in the art, the center convex ridge 26 of the span is formed first, for example by a roller die D having a radial rib protruding a distance for a selected height of ridge 26. The center convex ridge 26 defines a longitudinal center line through and a plane of symmetry about which the symmetrical halves of the span are subsequently formed, also by suitably shaped subsequent roller dies, to thereby center the entire symmetrical span structure about the longitudinal center line to thereby ensure accurate tracking and dimensional accuracy of the span through the progressive roller die formation process. Accurate symmetrical formation of vertical walls 16 is critical to the horizontal and vertical alignment of slots 17 which are punched into the walls at the end of the production process. Precise alignment of the slots is critical to the ultimate position of foundation springs inserted in the slots. The initial formation of the centered convex ridge 26 ensures that precise symmetry and alignment will be achieved in the roller die formation process.

The invention thus provides an improved mattress foundation steel span having increased strength and rigidity and wherein the novel center ridge improves fabrication of the span in the precise symmetrical configuration.

Although the invention has been described with respect to certain preferred embodiments, obvious variations on the basic concepts of the invention may be apparent to those skilled in the art. Such obvious variations are within the scope of the invention as defined by the accompanying claims and equivalents.

What is claimed is:

1. A mattress foundation having a frame and spring elements and wherein a plurality of steel spans are disposed generally perpendicular to a length of said frame and attached to said frame and said spring elements are interconnected with said plurality of said steel spans, each steel span comprising:

an elongate piece of formed steel having a two dimensional cross-section configuration including symmetrical spaced apart base portions having generally horizontal surfaces for contact with a mattress foundation frame, fastener holes formed in said base portions for insertion of fasteners therethrough whereby said steel span is attachable to a mattress foundation frame, said base portions further having upwardly curved outer lateral edges, symmetrical generally vertical walls spaced apart and attached through radiused bends to said base portions, said vertical walls having a vertical height greater than a horizontal width of each of said base portions, symmetrical horizontally and vertically aligned slots in opposing portions of said vertical walls, said aligned slots dimensioned to receive a spring element of a mattress foundation, a symmetrical crown portion above said aligned slots connected through radiused bends to top ends of said vertical walls and contiguous with coplanar flat surfaces generally parallel with said base portions, said coplanar flat surfaces having a combined horizontal width equal to at least one half a total horizontal width of said crown portion, and a ridge formed between and connected to laterally inward ends of said coplanar flat surfaces, said ridge having a rounded top disposed vertically above said flat surfaces.

* * * * *